US009598885B2

(12) United States Patent
Yamamoto et al.

(10) Patent No.: US 9,598,885 B2
(45) Date of Patent: Mar. 21, 2017

(54) LOCKING MEMBER, DOOR STOP, AND ROD LOCKING SYSTEM

(71) Applicant: MITSUBISHI STEEL MFG. CO., LTD., Tokyo (JP)

(72) Inventors: Junichiro Yamamoto, Tokyo (JP); Takao Endo, Chiba (JP)

(73) Assignee: MITSUBISHI STEEL MFG. CO., LTD., Tokyo (JP)

( * ) Notice: Subject to any disclaimer, the term of this patent is extended or adjusted under 35 U.S.C. 154(b) by 0 days.

(21) Appl. No.: 14/766,186

(22) PCT Filed: Mar. 27, 2015

(86) PCT No.: PCT/JP2015/059740
§ 371 (c)(1),
(2) Date: Aug. 6, 2015

(87) PCT Pub. No.: WO2015/152081
PCT Pub. Date: Oct. 8, 2015

(65) Prior Publication Data

US 2016/0265257 A1 Sep. 15, 2016

(30) Foreign Application Priority Data

Apr. 1, 2014 (JP) ..... 2014-075471

(51) Int. Cl.
*E05C 19/02* (2006.01)
*E05C 17/48* (2006.01)
(Continued)

(52) U.S. Cl.
CPC ..... *E05C 17/48* (2013.01); *E05B 17/0041* (2013.01); *E05B 63/22* (2013.01);
(Continued)

(58) Field of Classification Search
CPC ..... Y10T 292/0878; Y10T 292/096; Y10T 292/0976; Y10T 292/0977;
(Continued)

(56) References Cited

U.S. PATENT DOCUMENTS 1,038,111 A * 9/1912 Foss ..... E05C 19/04 292/75
2,941,831 A * 6/1960 Giancarlo ..... E05C 19/022 292/79
(Continued)

FOREIGN PATENT DOCUMENTS

CN 105525811 A * 4/2016
DE 1047062 B * 12/1958 ..... E05C 17/48
(Continued)

OTHER PUBLICATIONS

International Search Report mailed on Jun. 9, 2015.
Extended European Search Report mailed Nov. 21, 2016.

*Primary Examiner* — Kristina Fulton
*Assistant Examiner* — Christine M Mills
(74) *Attorney, Agent, or Firm* — IPUSA, PLLC

(57) ABSTRACT

A locking member for locking a rod in a path for the rod to pass through, wherein the path is formed to have a substantially heart shape, wherein the locking member includes a speed regulation path portion for regulating entrance speed by causing the rod that enters the path to fluctuate, and a locking portion for locking the rod whose entering speed is regulated, wherein the speed regulation path portion extends in a vertical direction that is perpendicular to a width direction of the locking member, and the speed regulation path portion includes rod receiving portions that are disposed at a start edge and an end edge, wherein the rod receiving portions are for regulating the entering speed by
(Continued)

receiving the fluctuation in a forward and backward direction of the rod that enters the speed regulation path portion.

6 Claims, 10 Drawing Sheets

(51) Int. Cl.

| | |
|---|---|
| ***E05C 17/08*** | (2006.01) |
| ***E05B 63/22*** | (2006.01) |
| ***E05F 5/08*** | (2006.01) |
| ***E05F 5/02*** | (2006.01) |
| ***E05F 5/06*** | (2006.01) |
| ***E05C 17/46*** | (2006.01) |
| ***E05B 17/00*** | (2006.01) |
| ***E05C 1/08*** | (2006.01) |

(52) U.S. Cl.
CPC ..... *E05C 1/08* (2013.01); *E05C 17/085* (2013.01); *E05C 17/46* (2013.01); *E05C 19/028* (2013.01); *E05F 5/02* (2013.01); *E05F 5/06* (2013.01); *E05F 5/08* (2013.01); *Y10S 292/04* (2013.01); *Y10S 292/15* (2013.01); *Y10S 292/19* (2013.01); *Y10T 292/0878* (2015.04); *Y10T 292/096* (2015.04); *Y10T 292/1016* (2015.04); *Y10T 292/71* (2015.04)

(58) Field of Classification Search
CPC . Y10T 292/1016; Y10T 292/71; Y10T 16/61; Y10T 16/625; Y10S 292/04; Y10S 292/15; Y10S 292/19; E05C 17/00; E05C 1/08; E05C 17/08; E05C 17/085; E05C 17/20; E05C 17/22; E05C 17/44; E05C 17/46; E05C 17/48; E05C 19/02; E05C 19/028; E05C 17/52; E05B 17/0041; E05B 63/22; E05F 5/02; E05F 5/06; E05F 5/08
USPC .... 292/74, 137, 170, 169, 140, 342, DIG. 4, 292/DIG. 15, DIG. 19; 16/82, 85
See application file for complete search history.

(56) References Cited

U.S. PATENT DOCUMENTS

| | | | | | |
|---|---|---|---|---|---|
| 2,985,908 | A * | 5/1961 | Allen | E05D 11/1085 16/303 |
| 4,421,348 | A * | 12/1983 | Kahn | E05C 19/004 292/339 |
| 4,917,416 | A * | 4/1990 | Westphal | E05B 65/0864 292/175 |
| 5,498,039 | A * | 3/1996 | Bivens | A47B 88/0477 292/145 |
| 7,576,980 | B2 * | 8/2009 | Lin | G06F 1/1613 361/679.55 |

FOREIGN PATENT DOCUMENTS

| | | | | |
|---|---|---|---|---|
| DE | 1166035 | B * | 3/1964 | E05C 19/022 |
| DE | 202009011772 | | 1/2010 | |
| GB | 982690 | A * | 2/1965 | E05C 17/46 |
| JP | 10252336 | A * | 9/1998 | |
| JP | 2004131997 | A * | 4/2004 | |
| JP | 2009167772 | A * | 7/2009 | |
| JP | 2010196412 | A * | 9/2010 | |
| JP | 2010-281194 | | 12/2010 | |
| JP | 2010281194 | A * | 12/2010 | |
| JP | 5382422 | | 1/2014 | |

* cited by examiner

LOCKING MEMBER, DOOR STOP, AND ROD LOCKING SYSTEM

TECHNICAL FIELD

The present invention relates to a locking member, a door stop, and a rod locking system.

BACKGROUND ART

A locking member has been known from the past which has a configuration such that the locking member locks a rod in a path for the rod to pass through. For example, it has been used for a door stop that is for locking a door (a gate) in a state in which it is opened. Such a door stop has a configuration such that a rod system including a rod that extends toward a floor is attached to a door, and that a rod locking system including a locking member for locking the rod is attached to a floor surface.

It has been known that the above-described locking member restricts movement of a rod in response to a motion of a door in a direction to open for a first time, and releases the restriction on the movement of the rod in response to the motion of the door in the direction to open for a second time. The locking member includes a path that enables the rod to move in a direction to close the door (cf. Patent Document 1, for example).

CITATION LIST

Patent Literature

[PTL 1] Patent Document 1: Japanese Patent No. 5382422

SUMMARY OF INVENTION

Technical Problem

In the above-described locking member, however, there is provided no means for regulating entering speed of the rod in the path. Consequently, for a rod whose entering speed is high, the locking member may not restrict movement of the rod within the path, and the locking member may allow the rod to go out from the path as it is.

For example, for a case in which the locking member having the above-described configuration is used for a door stop, when a user vigorously performs an operation in a direction to open the door, there is a problem that the locking member may not restrict the movement of the rod whose entering speed is high, and that the door may not be locked in an opened state.

An object of an embodiment of the present invention is conceived by considering the above-described point, and the object is to provide a locking member for restricting movement of a rod by reliably locking the rod, even if entering speed of the rod is high.

Solution to Problem

The above-described problem can be solved by a locking member for locking a rod in a path for the rod to pass through. The locking member includes a speed regulation path portion for regulating entering speed of the rod by causing the rod that enters inside the path to fluctuate; and a locking portion for restricting movement of the rod by locking the rod whose entering speed is regulated, wherein the speed regulation path portion extends in a vertical direction that is perpendicular to a width (short) direction of the locking member, and wherein the speed regulation path portion includes rod receiving portions that are disposed at a start edge and an end edge of the speed regulation path portion, respectively, wherein the rod receiving portions are for regulating the entering speed by receiving the fluctuation in a forward and backward direction of the rod that enters the speed regulation path portion.

Advantageous Effects of Invention

According to the present invention, movement of a rod can be restricted by reliably locking the rod by the speed regulation path portion that is for regulating entering speed of the rod, even if the entering speed of the rod is high.

DESCRIPTION OF EMBODIMENTS

Figure 1:
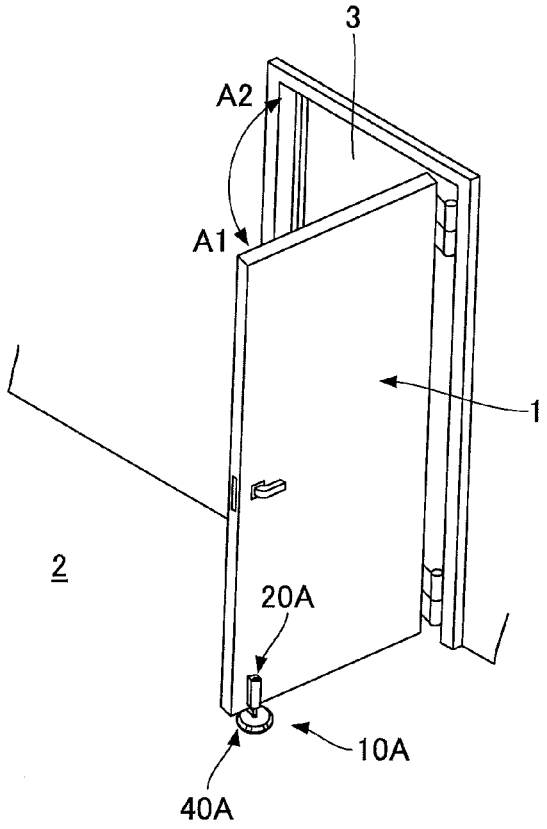
FIG. 1 is a perspective view showing an embodiment of a door stop according to a first embodiment of the present invention.

Next, there are explained embodiments of a locking member, a door stop and a rod locking system according to the present invention. In the drawings, the same reference numerals are attached to the same or corresponding parts, and duplicate explanations are appropriately simplified or omitted. The drawings are not intended to indicate relative ratios among members or components. Thus, specific dimensions can be determined by a person ordinarily skilled in the art, in light of the following non-limiting embodiments.

In the following, the locking member according to the present invention is implemented in the rod locking system, and it operates in a relationship with a rod system having a rod. Thus, in the following, the embodiment is explained by exemplifying the rod locking system that includes the locking member, and by exemplifying the door stop having the rod system. In the following, first, there are explained a configuration of the rod system that is included in the door stop and a configuration of the rod locking system. A configuration of the locking member is explained in the explanation of the rod locking system.

First Embodiment

Figure 2:
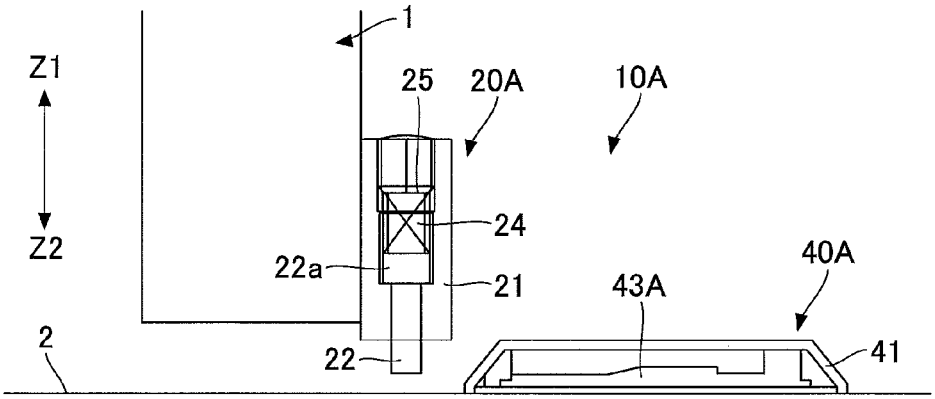
FIG. 2 is a partially transparent side view showing an implementation state of the door stop according to the first embodiment of the present invention.
Figure 4:
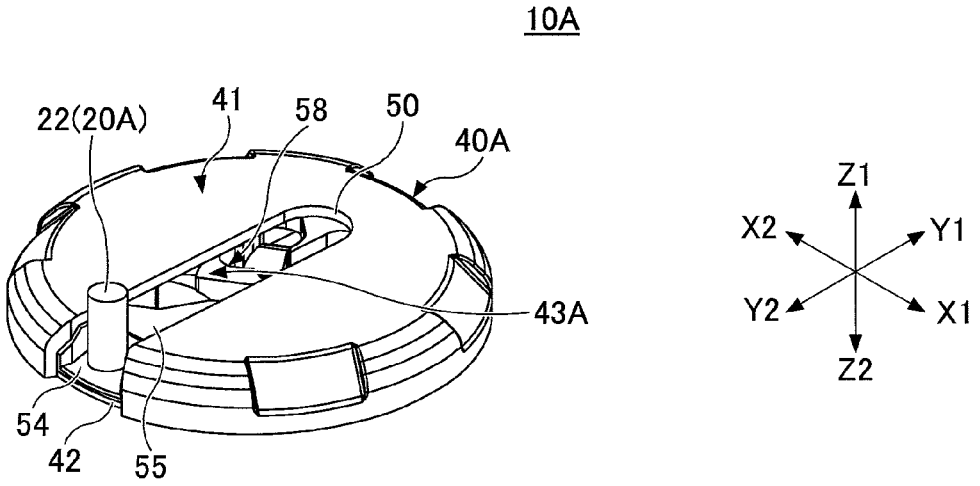
FIG. 4 is an overall perspective view showing a rod locking system that is included in the door stop according to the first embodiment of the present invention.
Figure 5:
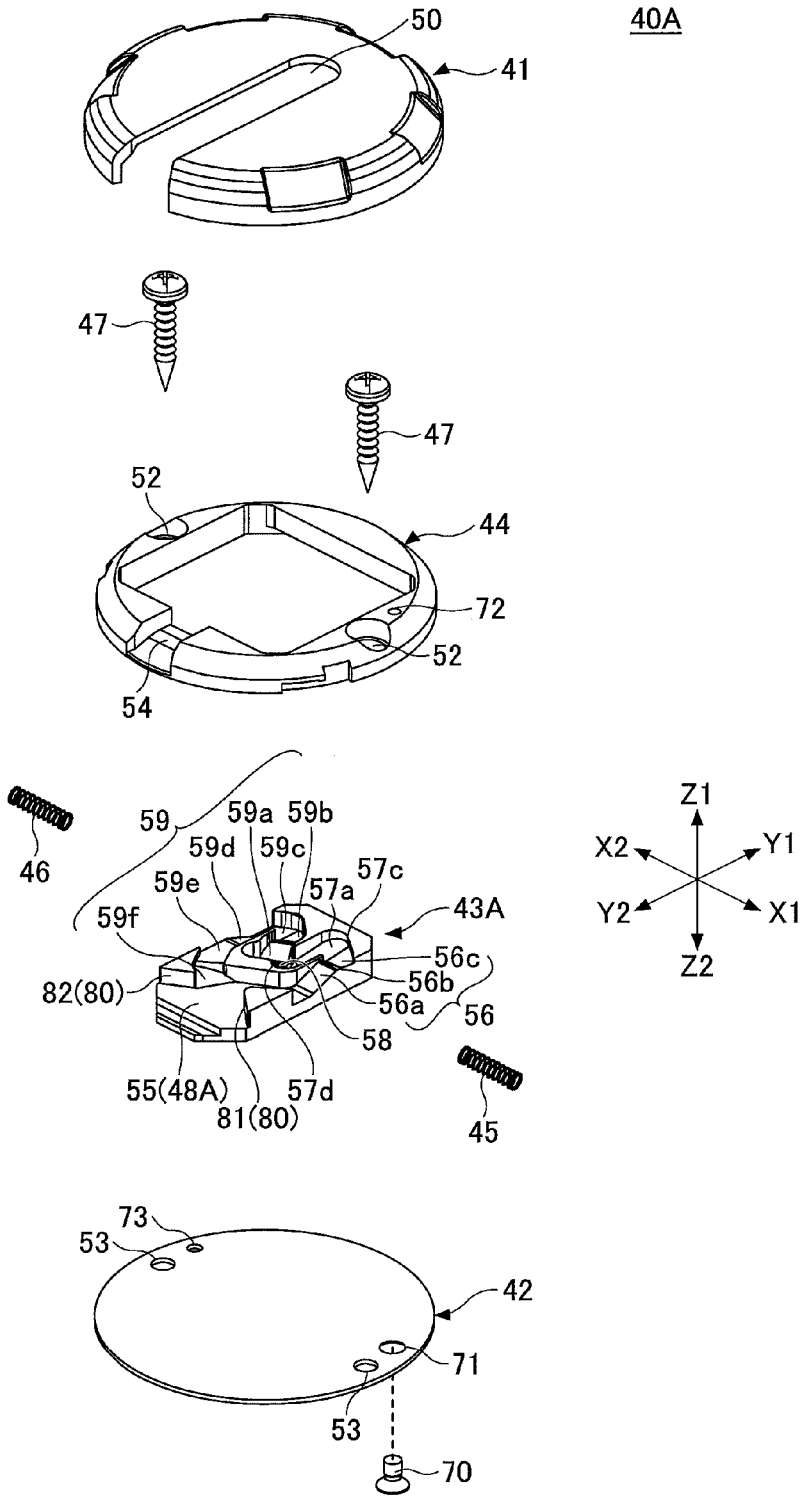
FIG. 5 is an exploded perspective view showing the rod locking system that is included in the door stop according to the first embodiment of the present invention.

FIGS. 1 and 2 show an example of a door stop 10A according to a first embodiment. FIG. 3 shows a configuration of a rod system 20A that is attached to a door 1. FIGS. 4 and 5 show a configuration of a rod locking system 40A in which a locking member is installed. FIG. 6 shows a specific configuration of the locking member.

As shown in FIG. 1, the door stop 10A is for locking the door 1 in an opened state. As enlarged and shown in FIG. 2, the door stop 10A is formed of the rod system 20A that is provided on the door 1, and the rod locking system 40A that is provided on a floor 2.

<The Rod System>

Figure 3A:
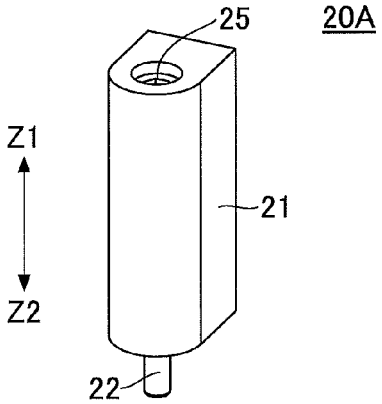
FIG. 3A is a perspective view showing a rod system that is included in the door stop according to the first embodiment of the present invention.
Figure 3B:
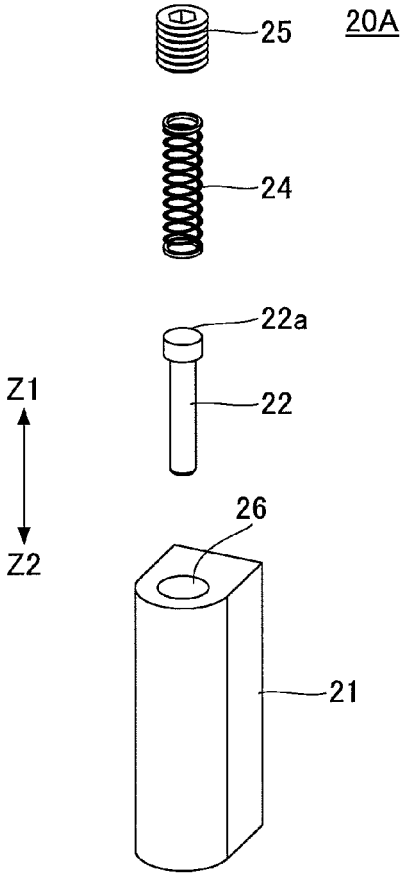
FIG. 3B is an exploded perspective view showing the rod system that is included in the door stop according to the first embodiment of the present invention.

As enlarged and shown in FIG. 3, the rod system 20A includes a case 21; a rod 22; a coil spring 24; and a fixing screw 25. FIG. 3A is a perspective view showing an external appearance of the rod system 20A, and FIG. 3B is an exploded perspective view of the rod system 20A.

A mounting hole 26 for mounting the rod 22 is provided in the case 21. As shown in FIG. 2, the mounting hole 26 is a hole having a step. Additionally, a predetermined range of an upper portion of the mounting hole 26 is formed to be a screw hole.

As described below, the rod 22 is locked to the rod locking system 40A, and the door 1 is locked in a state in which it is opened. A head portion 22*a* having a large diameter is formed at an upper end of the rod 22. The head portion 22*a* has a configuration such that it is locked to the step of the mounting hole 26, and the head portion 22*a* prevents the rod 22 from going through the case 21 (cf. FIG. 2).

Further, a coil spring 24 is inserted into the upper portion of the mounting hole 26, after the rod 22 is inserted into the mounting hole 26. Additionally, an upper portion of the coil spring 24 is fixed by screwing the fixing screw 25 to the screw hole of the mounting hole 26. Consequently, in a state in which the rod 22, the coil spring 24, and the fixing screw 25 are installed in the case 21, a configuration is obtained such that the rod 22 can be moved in a vertical direction (which is the direction that is indicated by Z1 and Z2 in the figure) with respect to the case 21.

The rod system 20A having the above-described configuration can be fixed to the door 1, so that the moving direction of the rod 22 is perpendicular (vertical) to the floor 2. A method of fixing the rod system 20A to the door 1 is not particularly limited. However, the rod system 20A can be fixed to the door 1 by using a fixing screw (not shown), for example.

The rod 22 extends toward the floor 2 from the case 21 in a state in which the rod system 20A is attached to the door 1. Further, the rod 22 has a configuration such that it is biased by the above-described coil spring 24, so that the rod 22 protrudes downward from the case 21. In addition, a lower end of the rod 22 is separated from the floor 2 in the attached state, and the height of the lower end of the rod 22 is maintained so that it can be locked to the rod locking system 40A, which is described below.

<Rod Locking System>

Next, the rod locking system 40A and a cam member 43A (which corresponds to an example of a locking member that is described in the claims) are explained by using FIGS. 4 to 6. Here, FIG. 4 is a perspective view showing an external appearance of the rod locking system 40A, and FIG. 5 is an exploded perspective view of the rod locking system 40A. FIG. 6A is a plan view showing the cam member 43A, FIG. 6B is a cross-sectional view of FIG. 6A, which is viewed in a direction of arrows I-I, and FIG. 6C is a cross-sectional view of FIG. 6A, which is viewed in a direction of arrows II-II.

The rod locking system 40A includes a cam cover 41; a base 42; the cam member 43A; a cam holder 44; and so forth.

A rod insertion groove 50 that extends in an entering direction of the rod 22 (the direction of the arrows Y1 and Y2) is formed at a center position of the cam cover 41. As described later, while locking the door 1 by the door stop 10A, the rod 22 that is provided in the rod system 20A that is fixed to the door 1 enters inside the rod insertion groove 50.

The base 42 is a plate member, and the base 42 is disposed at a lowermost position of the rod locking system 40A. The shape of the base 42 corresponds to a shape of the cam cover 41. The cam member 43A and the cam holder 44 are accommodated in a space that is formed inside the cam cover 41 and the base 42.

(The Cam Member (an Example of a Locking Member))

Hereinafter, a configuration of the locking member (the cam member 43A) is specifically explained, based on FIGS. 5 and 6. As shown in FIGS. 5 and 6, a rod path 48A (which corresponds to an example of a path of the scope of the claims) that is for the rod 22 to travel (to pass through) is formed in the cam member 43A. The rod path 48A includes a rod entrance 55; an entrance path 56; a speed regulation path 57 (which corresponds to an example of a speed regulation path portion that is described in the claims); a locking portion 58; and a return path 59.

Further, the rod entrance 55, the entrance path 56, the speed regulation path 57, the locking portion 58, and the return path 59 that form the rod path 48A are formed so that the overall planar view has a substantially heart shape. There is an advantage for forming the rod path 48A to have the substantially heart shape, as described above, such that the cam member 43A can be made small in size. Additionally, a protrusion 61 that protrudes with respect to the rod path 48A is formed at an inner portion of the rod path 48A. Note that the rod path 48A has a configuration to prevent the rod 22 from moving backward during traveling of the rod 22 inside the rod path 48A.

The entrance path 56 is formed between the rod entrance 55 from which the rod 22 of the rod system 20A enters and the speed regulation path portion 57 that is for regulating the entering speed of the rod 22 by fluctuating the rod 22. During a motion of the door 1 in an opening direction for a first time, the rod 22 moves inside the entrance path 56 toward the speed regulation path 57 (toward the direction of the arrow Y1).

The entrance path 56 has a configuration that includes, from the side of the rod entrance 55, a flat ascending portion 56*a*; a flat portion 56*b*; and a recess surface portion 56*c*.

The flat ascending portion 56*a* is a tilted surface that extends obliquely upward from the rod entrance 55. An upper end portion of the flat ascending portion 56*a* is connected to an end portion of the flat portion 56*b* in the direction of the arrow Y2. Further, an end portion of the flat portion 56*b* in the direction of the arrow Y1 is connected to an end portion of the recess surface portion 56*c*. The recess surface portion 56*c* is formed at a position that is lower than the flat portion 56*b*, and a step portion is formed between the flat portion 56*b* and the recess surface portion 56*c*. Further, the other end portion of the recess surface portion 56*c* is connected to the speed regulation path 57.

The planar view of the entrance path 56 has a shape such that, first it extends obliquely in the right direction (the direction of the arrow X1), and subsequently it extends linearly in the direction of the arrow Y1, as moved toward the direction of the arrow Y1 from the rod entrance 55.

The speed regulation path 57 has a configuration that includes, from the side of the above-described recess surface portion 56*c* of the entrance path 56, a recess surface portion 57*a*; and a flat ascending portion 57*b* (which corresponds to an example of a tilted portion of the scope of the claims). The recess surface portion 57*a* is a tilted surface that further extends obliquely downward from the above-described recess surface portion 56*c*. A lower end portion (at the side of the arrow Y2) of the recess surface portion 57*a* is connected to an end portion of the flat ascending portion 57*b* at the side of the arrow Y1. Due to a difference in height between the recess surface portion 57*a* and the flat ascending portion 57*b*, the entering speed of the rod 22 can be reduced, as the rod 22 fluctuates in the speed regulation path 57 like a pendulum, and at the same time, the rod 22 can be prevented from moving backward. In the illustrated example, the speed regulation path 57 has the configuration that includes the recess surface portion 57*a* and the flat ascending portion 57*b*. However, entering speed of a rod can be regulated by stepwisely arranging a plurality of step portions that are different in height.

Further, a left side portion at a lower position of the recess surface portion 57*a* (an end portion at the side of the arrow X2) is connected to the locking portion 58. Note that, in the flat ascending portion 57*b*, the tilted surface is tilted in a direction to guide the rod 22, whose entering speed is regulated, toward the neighboring locking portion 58. In the obliquely upper right area in the plan view of FIG. 6A, the tilted surface is tilted by approximately 45 degrees in the direction of the arrows X1 and X2 (in the direction that is perpendicular to the entering direction).

The speed regulation path 57 has a function to regulate entering speed of the rod 22 by causing the entered rod 22 to fluctuate back and forth in the direction of the arrows Y1 and Y2. Specifically, the speed regulation path 57 includes rod receiving portions 57*c* and 57*d* for receiving fluctuation of the rod 22. The rod receiving portions 57*c* and 57*d* are provided at a start edge and an end edge of the speed regulation path 57 in the entering direction of the rod (the direction of the arrow Y2), and the rod receiving portions 57*c* and 57*d* may preferably be formed to have semi-arc shapes, so that they can receive the outer peripheral surface of the rod 22. The semi-arc shape is not limited to an exactly semi-arc shape. The semi-arc shape may include a substantially semi-arc shape that can receive the outer peripheral surface of the rod 22, and that is almost the same as the exactly semi-arc shape. The shape that "can receive the outer peripheral surface of the rod" in the scope of the claims and in this specification indicates a shape such that, when the rod 22 enters and contacts the rod receiving portion 57*d*, it can contact the outer peripheral surface of the rod 22 to the extent that rod 22 can be prevented from sideslipping (in the direction of the arrow X2). When the rod 22 whose entering speed is high contacts the rod receiving portion 57*d* and sideslips, and when the rod 22 moves to the locking portion 58 as it is, without reducing the speed, the rod 22 may pass through the return path 59 without locking to the locking portion 58, and the rod 22 may go through the rod locking system 40A. Thus, in order to reduce (regulate) the entering speed of the rod 22, it is especially important that the rod receiving portion 57*d* has the shape with which the rod 22 can be prevented from sideslipping. The shape of the rod receiving portion 57*d* may be a bent shape, such as a V-shape.

With the above-described configuration, even if the rod 22 whose entering speed is high contacts the rod receiving portions 57*c* and 57*d*, the rod receiving portions 57*c* and 57*d* can reliably receive the rod 22, and the rod receiving portions 57*c* and 57*d* can return the rod 22 in the opposite directions. Thus, the rod 22 can be fluctuated (movement indicated by the arrow H1) in the speed regulation path 57. After the rod 22 is fluctuated in the speed regulation path 57 and the entering speed is regulated, the rod 22 is guided to the neighboring locking portion 58. The rod 22 whose entering speed is regulated moves naturally to the locking portion 58 (movement toward the arrow H2) because, as described above, the tilted surface of the flat ascending portion 57*b* is tilted in the direction such that the rod 22 can be guided to the locking portion 58. For a case in which the entering speed of the rod 22 is not regulated, the rod 22 may not be guided to the locking portion 58 because the moving force toward the fluctuation direction (the arrow H1) is greater than the force to guide toward the locking portion 58 (the arrow H2). As the force for moving the rod 22 toward the fluctuation direction is regulated and the force to guide toward the locking portion 58 becomes greater, the rod 22 naturally moves to the locking portion 58.

Figure 6A:
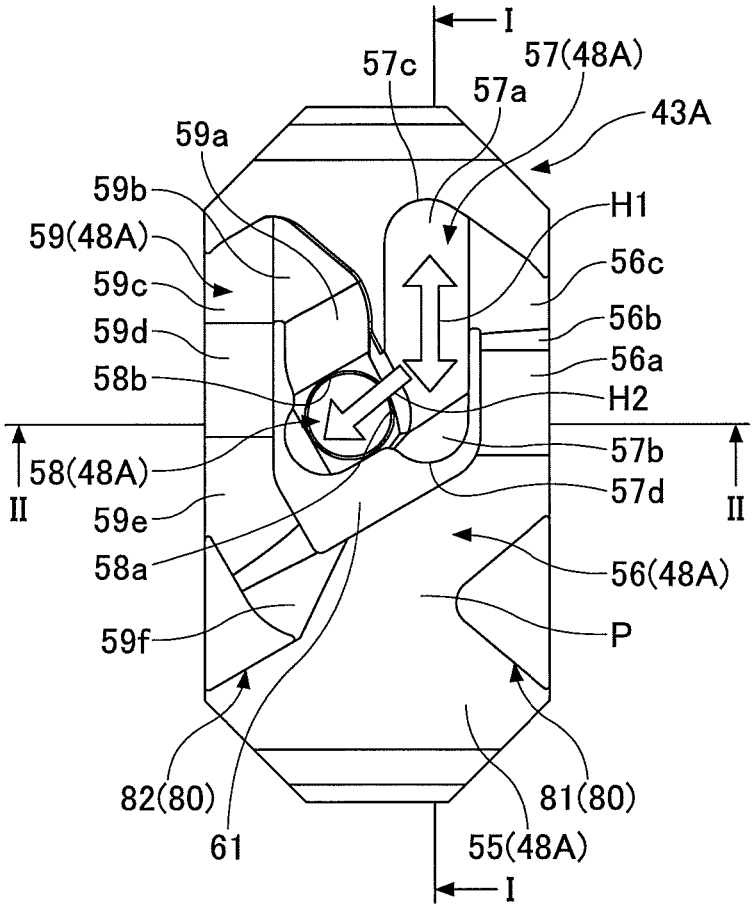
FIG. 6A is a plan view showing a cam member that is included in the door stop according to the first embodiment of the present invention.
Figure 6A:
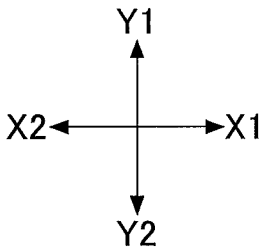
Figure 6B:
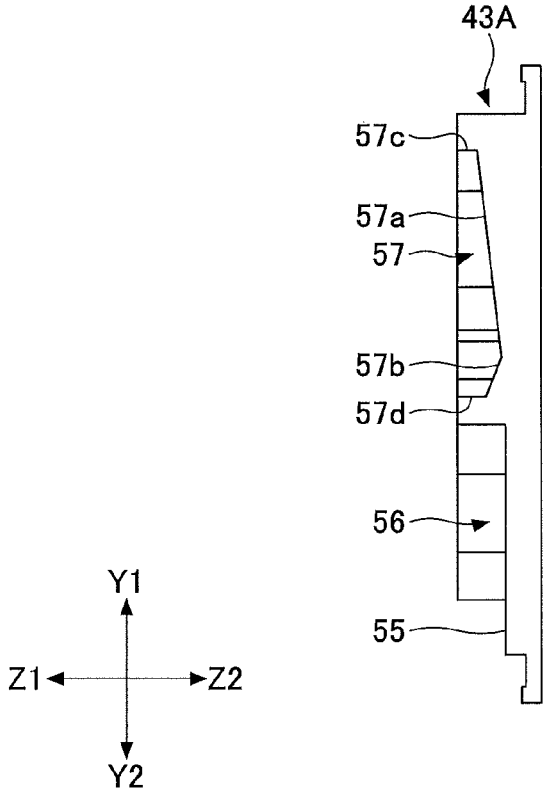
FIG. 6B is a cross-sectional view showing the cam member, which is viewed in a direction of I-I arrows in FIG. 6A, that is included in the door stop according to the first embodiment of the present invention.
Figure 6C:
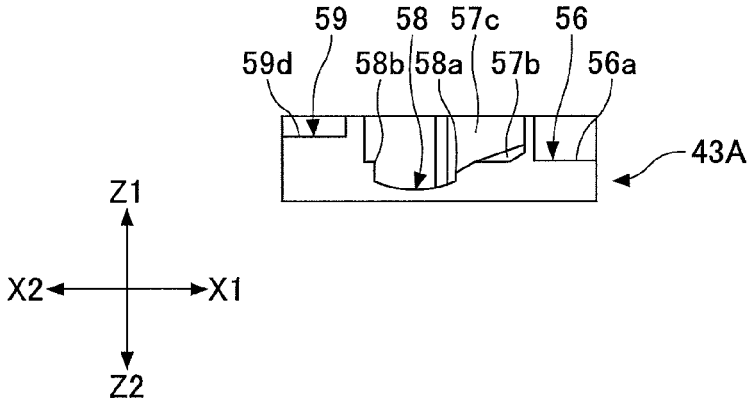
FIG. 6C is a cross-sectional view showing the cam member, which is viewed in a direction of II-II arrows in FIG. 6A, that is included in the door stop according to the first embodiment of the present invention.

Note that the height of the end portion of the recess surface portion 57*a* at the side of the locking portion 58 from the floor 2 is greater than the height of the locking portion 58 from the floor 2 (cf. FIG. 6C). Thus, a step portion is formed between the left side portion (the end portion at the side of the arrow X2) at the lower position of the recess surface portion 57*a* and the locking portion 58.

The locking portion 58 has a configuration such that it can lock the rod 22 that travels inside the rod path 48A. Namely, a portion between a speed regulation path side end portion 58*a* of the locking portion 58 and a return path side end portion 58*b* of the locking portion 58 is formed to have a curved shape, and the curved shape is adjusted so that it corresponds to the diameter of the rod 22.

Additionally, the height of the locking portion 58 from the floor 2 is adjusted so that it is less than the height of the recess surface portion 57*a* from the floor 2, and it is less than a height of a recess surface portion 59*b*, which is described below. Consequently, upon the rod 22 entering inside the locking portion 58, the rod 22 is locked by the locking portion 58.

Note that, upon the rod 22 being locked to the locking portion 58, the rod 22 may not move backward to the speed regulation path 57 because a step is formed between the locking portion 58 and the recess surface portion 57*a*.

The return path 59 is formed between the locking portion 58 and the rod entrance 55. In response to performing operation in the direction to open the door 1 for the second time, the rod 22 moves in the return path 59 toward the rod entrance 55 (toward the direction of the arrow Y2).

The return path 59 has a configuration that includes, from the side of the locking portion 58, a flat ascending portion 59*a*; the recess surface portion 59*b*; a flat portion 59*c*; a flat ascending portion 59*d*; a flat portion 59*e*; and a recess surface portion 59*f*.

The flat ascending portion 59*a* is a tilted surface that extends obliquely upward from the locking portion 58. An upper end portion of the flat ascending portion 59*a* is connected to an end portion of the recess surface portion 59*b*. The recess surface portion 59*b* is lower than the height of the upper end portion of the flat ascending portion 59*a*, and a step is formed between the recess surface portion 59*b* and the upper end portion of the flat ascending portion 59*a*.

Further, the end portion of the recess surface portion 59*b* at a side of the arrow Y2 is connected to an end portion of the flat portion 59*c*. The end portion of the flat portion 59*c* at the side in the direction of the arrow Y2 is connected to an upper end portion of the flat ascending portion 59*d*. The flat ascending portion 59*d* is a tilted surface that extends obliquely upward from the flat portion 59*c*. A lower end portion of the flat ascending portion 59*d* is connected to an end portion of the flat portion 59*e* at a side in the direction of the arrow Y1.

Further, the end portion of the flat portion 59*e* at the side in the direction of the arrow Y2 is connected to an upper end portion of the recess surface portion 59*f*. The recess surface portion 59*f* is a tilted surface that extends obliquely downward from the flat portion 59*e*. The recess surface portion 59*f* is connected to the above-described rod entrance 55.

In response to performing operation in the direction to open the door 1 for the second time, the rod 22 that is locked to the locking portion 58 travels to go upward along the flat ascending portion 59*b*. Then, the rod 22 reaches the return path 59. The specific operation of the door stop 10A is described below.

In the door stop 10A according to the embodiment, a rod insertion guide portion 80 is provided in the cam member 43A.

The rod insertion guide portion 80 is formed on a side that faces the rod entrance 55 of the cam member 43A (the side of the arrow Y2 in the figure). The rod insertion guide portion 80 is famed of a pair of guide surfaces 81 and 82. Further, the rod entrance 55 is formed at the portion between the pair of the guide surfaces 81 and 82.

The rod insertion guide portion 80 can perform a function to guide the rod 22 that travels through the rod entrance 55 toward a rod path end portion P of the rod path 48A.

The rod insertion guide portion 80 has, in a plan view state (the state that is shown in FIG. 6A), a pivot at the side of the rod path end portion P, and the rod insertion guide portion 80 has a fan shape that spreads toward the side of the rod entrance 55. Specifically, the guide surface 81 forms, from the rod path end portion P toward the side of the rod entrance 55, a tilted surface that spreads toward a side of the direction of the arrow X1 in the figure. The guide surface 82 forms, from the rod path end portion P toward the side of the rod entrance 55, a tilted surface that spreads toward a side of the direction of the arrow X2 in the figure.

Further, each of the guide surfaces 81 and 82 that are included in the rod insertion guide portion 80 is formed of a wall surface that protrudes upward with respect to the rod entrance 55 (cf. FIG. 5, for example). Thus, as the rod 22 travels in the rod locking system 40A and contacts the guide surface 81 or the guide surface 82, the rod 22 can travel toward the rod path end portion P while it is guided by the guide surface 81 or the guide surface 82.

(The Cam Holder)

The cam holder 44 that is included in the rod locking system 40A has a circular shape, and the cam holder 44 includes a rod entrance 54 through which the rod 22 passes (cf. FIG. 5, for example). The above-described cam member 43A is installed inside the cam holder 44. In the installed state, the cam member 43A has a configuration such that, as the cam member 43A is pushed by the rod 22 due to traveling of the rod 22, the cam member 43A slidably moves in the cam holder 44 in the direction of the arrows X1 and X2 in the figure. The sliding movement is performed by sliding on the base 42.

(Cam Springs)

Additionally, cam springs 45 and 46 are installed between the cam member 43A and the cam holder 44. The cam spring 45 is disposed between a side surface of the cam member 43A at a side in the direction of the arrow X1 and the cam holder 44. Further, the cam spring 46 is disposed between a side surface of the cam member 43A at a side in the direction of the arrow X2 and the cam holder 44.

Thus, for a case in which the cam member 43A moves in the direction of the arrow X1 in the cam holder 44, the cam spring 45 contracts, and elastic force for biasing the cam member 43A to move in the direction of the arrow X2 is generated. Further, for a case in which the cam member 43A moves in the direction of the arrow X2 in the cam holder 44, the cam spring 46 contracts, and elastic force for biasing the cam member 43A to move in the direction of the arrow X1 is generated. In the depicted example, one cam spring 45 and one cam spring 46 are disposed at both sides of the cam member 43A respectively. However, the numbers are not limited to these, and the numbers can be modified appropriately.

In order to attach the rod locking system 40A having the above-described configuration to the floor 2, the cam member 43A and the cam springs 45 and 46 are assembled between the base 42 and the cam holder 44, and the cam holder 44 and the base 42 are fixed to the floor 2 by using fastening screws 47. After the cam member 43A and the cam springs 45 and 46 are assembled between the base 42 and the cam holder 44, a fastening screw 70 is inserted into an insertion hole 71 from a rear surface of the base 42, and the fastening screw 70 is screwed in a screw hole 72 that is provided in the cam holder 44, thereby fixing the above-described members in the assembled state. At this time, although detailed descriptions are omitted, a protrusion that is for preventing the base 42 from being rotated and that protrudes downward is provided on the lower surface of the cam holder 44, and a dowel hole 73 that is for fitting the above-described protrusion is provided in the base 42. Thus, upon the cam holder 44, the cam member 43A, and the base 42 are fastened by the fastening screw 70, the above-described protrusion and the dowel hole 73 are fit together, and thereby the base can be prevented from being rotated. Note that the assembly of the cam member 43A and the cam springs 45 and 46 may be performed after the cam holder 44 and the base 42 are fixed to the floor 2.

Insertion holes 52 are formed in the cam holder 44, and insertion holes 53 are formed in the base 42. Thus, the base 42 and the cam holder 44 can be fixed to the floor 2 by screwing the fastening screws 47 into the floor 2 through the insertion holes 52 and the insertion holes 53, respectively.

The cam cover 41 has a configuration such that it can be fit to an outer periphery of the cam holder 44. Thus, after the base 42, the cam holder 44, and so forth are fixed to the floor 2, the rod locking system 40A can be fixed to the floor 2 by fitting the cam cover 41 to the cam holder 44. Note that an installation position of the rod locking system 40A to the floor 2 can be adjusted to a position where the door 1 is desired to be locked on the floor 2.

<Operation>

Next, there is explained an operation of the door stop 10A having the above-described configuration. In particular, the operation of the locking member (the cam member 43A) is mainly explained.

FIGS. 7A-7F are diagrams (1)-(6) for illustrating the operation of the door stop 10A. Note that, in the figures, for convenience of depiction and explanation, only the rod 22 is shown for the rod system 20A, and depiction of the cam cover 41 and the base 42 is omitted for the rod locking system 40A.

Figure 7A:
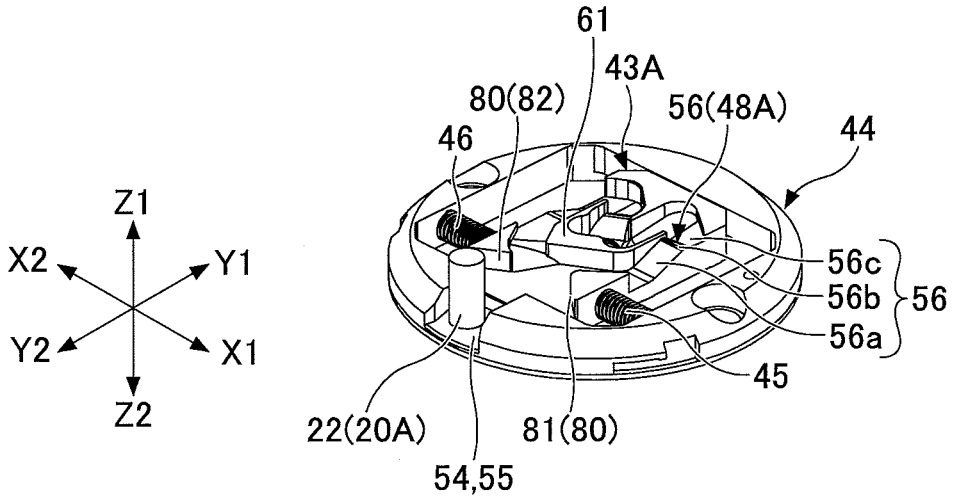
FIG. 7A is a diagram (1) illustrating an operation of the door stop according to the first embodiment of the present invention.

FIG. 7A shows a state (the state is referred to as a "free state," hereinafter) in which the rod 22 is located at the rod entrance 54 (and the rod entrance 55) of the rod locking system 40A in accordance with a motion of the door 1 in the direction to open for the first time. Here, "the motion of the door 1 in the direction to open for the first time" is an operation for opening the door 1 and for locking the door 1 to the door stop 10A. Further, "the direction to open" refers to a direction in which the door 1 in the state in which an entrance 3 is closed is to be opened, and refers to the direction that is indicated by the arrow A1 in FIG. 1.

The free state is a state in which the rod 22 does not proceed to rod path 48A yet. In the free state, the cam springs 45 and 46 are in a state of equilibrium, and thus the cam member 43A is in a state such that it is positioned at the center of the cam holder 44. In this state, the rod entrance 55 of the cam member 43A is maintained at a position that corresponds to the rod entrance 54 of the cam holder 44 and the rod insertion groove 50 of the cam cover 41.

Figure 7B:
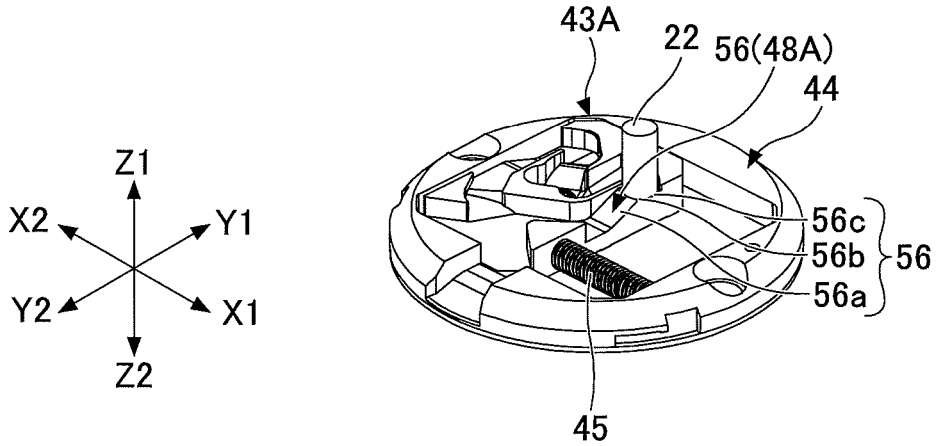
FIG. 7B is a diagram (2) illustrating the operation of the door stop according to the first embodiment of the present invention.

As shown in FIG. 7B, as the door 1 is further moved in the direction to open relative to the free state, the rod 22 moves in the direction of the arrow Y1 along the entrance path 56 that is included in the rod path 48A. FIG. 7B shows a state in which the rod 22 goes up along the flat ascending portion 56*a*, and proceeds to the recess surface portion 56*c*.

At this time, during a motion of the door 1 in the direction to open for the first time, the rod 22 travels to the entrance path 56, without proceeding to the return path 59, because the rod insertion guides 80 are formed at the both ends of the rod entrance 55, as described above.

The cam member 43A is moved in the direction of the arrow X2 in the figure, as the rod 22 travels in the entrance path 56. That is because the rod 22 is also guided by the rod insertion groove 50 that is formed in the cam cover 41. Thus, the cam spring 46 is contracted. Consequently, the cam spring 46 applies elastic force to the cam member 43A that is for biasing the cam member 43A to move in the direction of the arrow X1.

As the rod 22 further travels in the direction of the arrow Y1 relative to the state that is shown in FIG. 7B, the rod 22 enters the speed regulation path 57 from the recess surface portion 56*c*.

Figure 7C:
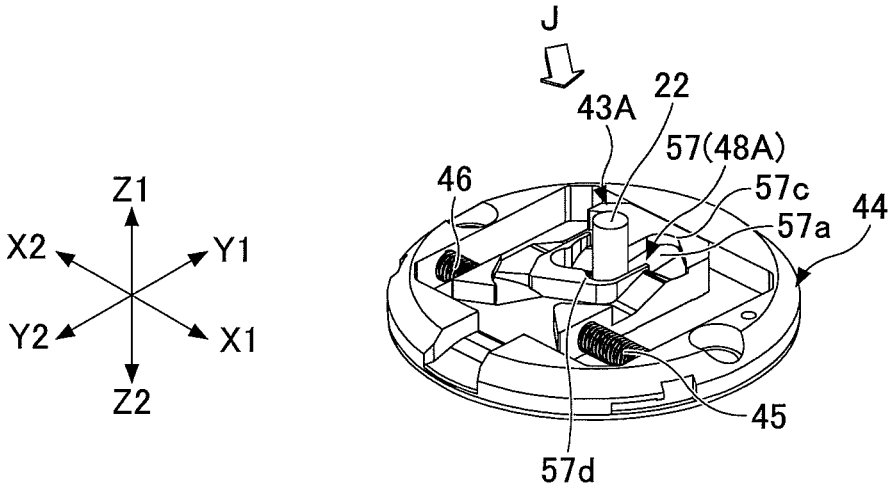
FIG. 7C is a diagram (3) illustrating the operation of the door stop according to the first embodiment of the present invention.
Figure 7D:
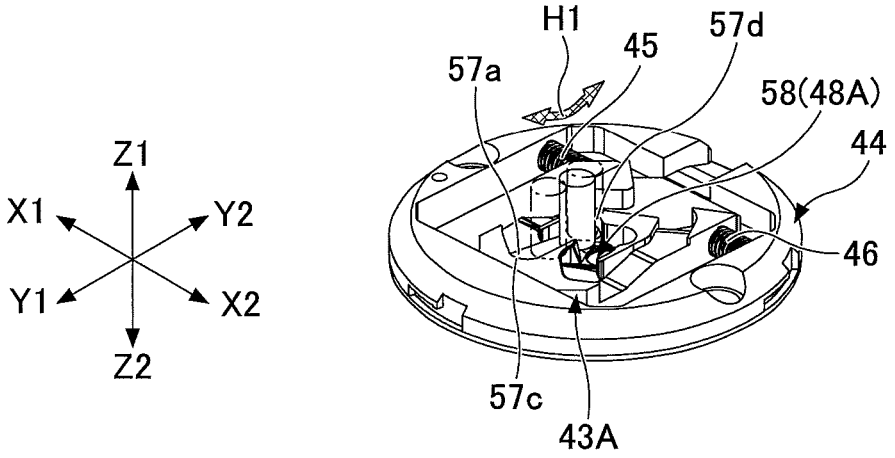
FIG. 7D is a diagram (4) illustrating the operation of the door stop according to the first embodiment of the present invention.

FIGS. 7C and 7D show situations such that the rod 22 that enters inside the speed regulation path 57 is fluctuated, and the entering speed is regulated. FIG. 7D is a perspective view that is viewed in the direction of the arrow J of FIG. 7C.

In the speed regulation path 57, first the rod 22 contacts the rod receiving portion 57*c* that is provided at the start edge. The rod receiving portion 57*c* receives the outer peripheral surface of the rod 22, and bounces the rod 22 in the direction (the direction of the arrow Y2) toward the rod receiving portion 57*d* that is provided at the end edge of the speed regulation path 57. The rod receiving portion 57*d* causes the contacted rod 22 to fluctuate, without causing the rod 22 to sideslip to the side of the locking portion 58, by bouncing the rod 22 in the direction (the direction of the arrow Y1) that is opposite to the entering direction (the direction of the arrow Y2).

The entering speed of the rod 22 can be regulated (reduced) by performing the fluctuation operation (the arrow H1) between the rod receiving portions 57*c* and 57*d* that face each other. In addition, by the difference in height (cf. FIGS. 6A and 6B) between the recess surface portion 57*a* and the flat ascending portion 57*b* that are formed in the speed regulation path 57, the fluctuation and deceleration of the rod 22 can be smoothed.

As the rod 22 fluctuates in the speed regulation path 57 and the entering speed is regulated, the rod 22 is guided to the neighboring locking portion 58, and the rod 22 is locked. That is because the tilted surface of the flat ascending portion 57*b* of the speed regulation path 57 is tilted in the direction to guide the rod 22 to the locking portion 58. The rod 22 whose entering speed is regulated is moved naturally to the locking portion 58. Note that, for a case in which the entering speed of the rod 22 is not regulated, the rod 22 may not be guided to the locking portion 58 because the moving force toward the fluctuation direction (the arrow H1) is greater than the force to guide toward the locking portion 58 (the arrow H2 in FIG. 6A). As the force for moving the rod 22 toward the fluctuation direction is regulated and the force to guide toward the locking portion 58 (the arrow H2 in FIG. 6A) becomes greater, the rod 22 naturally moves to the locking portion 58.

Figure 7E:
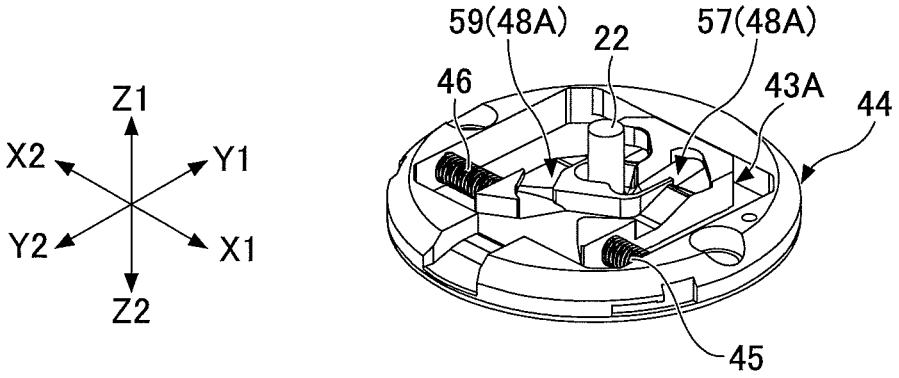
FIG. 7E is a diagram (5) illustrating the operation of the door stop according to the first embodiment of the present invention.

FIG. 7E shows a state in which the rod 22 is locked to the locking portion 58. As shown in FIG. 6C, the locking portion 58 is lower than the height of the left side portion at the lower position of the recess surface portion 57*a* that is included in the speed regulation path 57, and the locking portion 58 is lower than the height of the lower end portion of the flat ascending portion 59*a* that is included in the return path 59. Thus, movement of the rod 22 is restricted by the recess surface portion 57*a* and the flat ascending portion 59*a*. Then, in the locking portion 58, movement of the rod 22 in the direction of the arrows X1 and X2 is restricted.

Note that, especially for a case in which a user vigorously opens the door 1, FIGS. 7A to 7E proceed in a series of operations.

Further, for a case in which an operation is performed to the door 1 in the direction of the arrow Y2 (the operation in the direction to close the door 1), force is applied to the rod 22 in the direction to close (the direction of the arrow Y2). However, a protrusion 61 is formed at a side in the direction of the arrow Y2 with respect to the locking portion 58 of the cam member 43A. Movement of the rod 22 in the direction of the arrow Y2 is restricted by the protrusion 61. Thus, even if force is applied in the direction to close (the direction of the arrow Y2), the door 1 may not be closed, and the opened state can be maintained (this state is referred to as the "locked state," hereinafter).

In order to release the locked state and close the door 1, the door 1 is moved again in the direction to open (the direction of the arrow Y1) (this motion is referred to as the "motion of the door in the direction to open for the second time").

In this manner, by moving the door 1 in the direction to open (the direction of the arrow Y1), the rod 22 proceeds to the return path 59. Specifically, the rod 22 goes up along the flat ascending portion 59*a*, and the rod 22 falls to the recess surface portion 59*b* after the rod 22 completely goes up. Then, the rod 22 is separated from the locking portion 58 and the speed regulation path 57, thereby releasing the locking between the rod 22 and the locking portion 58.

Figure 7F:
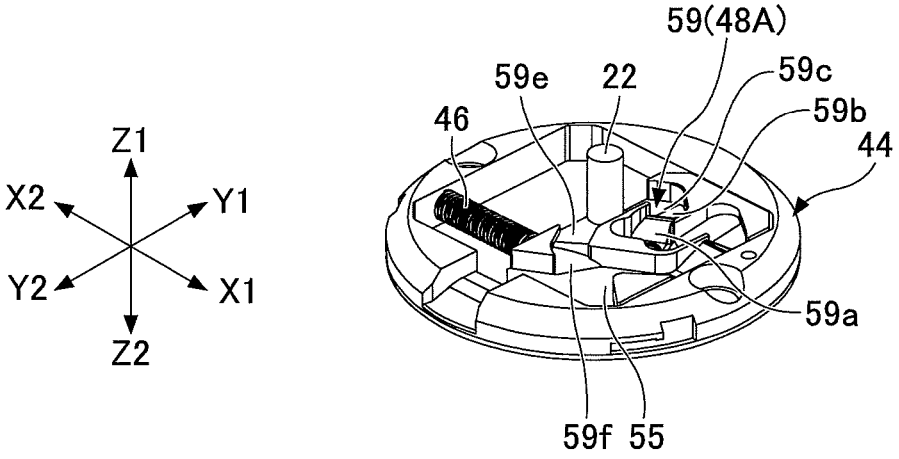
FIG. 7F is a diagram (6) illustrating the operation of the door stop according to the first embodiment of the present invention.

FIG. 7F shows a state in which the rod 22 is moving in the return path 59 in the direction of the arrow Y2.

Note that, as described above, the step is formed between the locking portion 58 and the recess surface portion 57*a*, so that the rod 22 may not be moved backward to the side of the speed regulation path 57 by the motion of the door in the direction to open for the second time.

For a case of closing the door 1, force is applied to the door 1 in the direction to close (the direction that is indicated by the arrow A2 in FIG. 1). The force is also applied to the rod 22, so that the rod 22 moves in the return path 59 in the direction of the arrow Y2. Specifically, the rod 22 travels in the direction of the arrow Y2 from the recess surface portion 59*b* to the flat portion 59*c*, and subsequently the rod 22 goes up along the flat ascending portion 59*d* and reaches the flat portion 59*e* and the recess surface portion 59*f*. In this manner, the rod 22 leaves the return path 59 and reaches the rod entrance 55.

In a state in which the rod 22 is moved to the vicinity of the rod entrance 54 of the cam holder 44, the cam member 43A is also moved to the substantially center portion. The rod entrance 54 matches the rod entrance 55, and they are in a communicated state. Thus, by further moving the rod 22 in the direction of the arrow Y2, the rod 22 (the rod system 20A) can leave the rod locking system 40A. Then, a series of locking operations of the door 1 by the door stop 10A is completed.

As described above, the door stop 10A according to the embodiment has a configuration such that the speed regulation path 57 is included in the rod path 48A for the rod 22 that is provided in the cam member 43A. The speed regulation path 57 further includes the rod receiving portions 57*c* and 57*d* that have shapes such that collision of the rod 22 can be reliably received and the rod 22 can be bounced in the opposite directions, so as to fluctuate the rod 22 and regulate the entering speed. Thus, even if a user vigorously performs the operation on the door in the direction to open (the direction of the arrow A in FIG. 1), the above-described configuration can reliably reduce (regulate) the entering speed of the rod. Thus, the rod 22 can be reliably locked to the locking portion 58, and movement of the rod can be locked. By doing this, the rod 22 can be prevented from passing through the locking portion 58 as it is. Consequently, safety can be dramatically improved, and versatility can be enhanced because it can be positively implemented in a place where there are children, or a windy place.

Second Embodiment

Next, there is explained a door stop 10B according to a second embodiment. The door stop 10A according to the first embodiment includes the cam springs 45 and 46 for generating elastic force for biasing the cam member 43A to move in the direction of the arrow X1 or in the direction of the arrow X2.

Figure 8A:
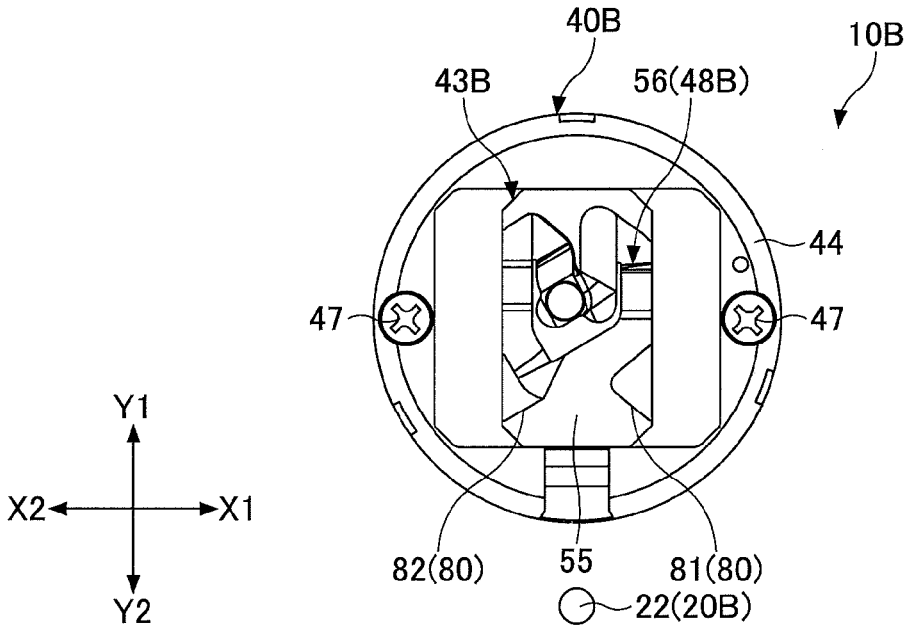
FIG. 8A is a plan view illustrating a configuration of the door stop according to a second embodiment of the present invention.
Figure 8B:
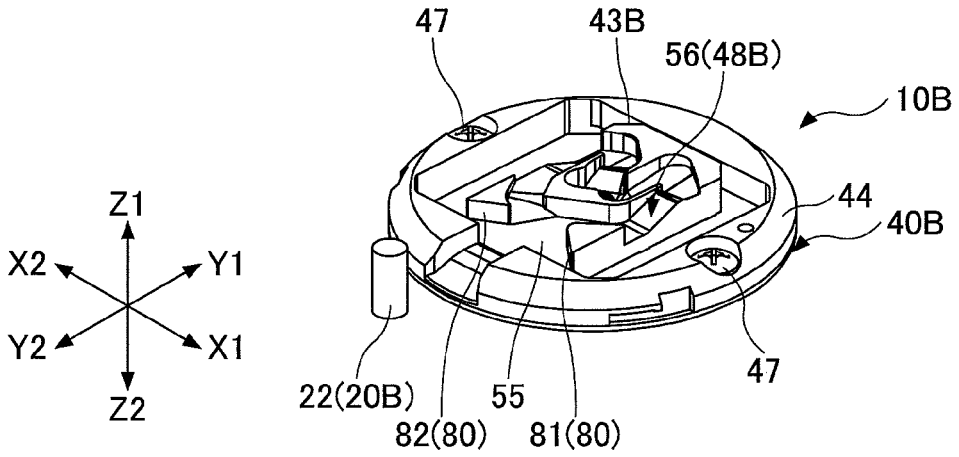
FIG. 8B is a perspective view illustrating the configuration of the door stop according to the second embodiment of the present invention.

As shown in FIG. 8, the door stop 10B according to the second embodiment is an embodiment in which no cam spring is installed. Note that, in the figure, for convenience of the depiction and explanation, only the rod 22 is shown for the rod system 20B, and depiction of the cam cover 41 and the base 42 is omitted for the rod locking system 40B.

The embodiment is different from the door stop 10A according to the first embodiment only in a point that no cam spring is included. Thus, the explanation is omitted because other configurations and operations are the same.

As described above, in the embodiment, the rod locking system 40B does not include any cam spring. Consequently, a configuration is such that the cam member 43B can be freely moved in the cam holder 44 in the direction of the arrows X1 and X2. Thus, it is possible that the cam holder 44 may not be located at the center position prior to entrance of the rod 22. The rod 22 may not enter the rod entrance 55 at the center. However, as described above, the rod insertion guide portion 80 that is provided in the cam member 43B has the fan shape such that it spreads toward the side of the rod entrance 55. Once the rod 22 enters the rod entrance 55, it can be guided to the entrance path 56 (the rod path 48B) by the rod insertion guide 80, no matter where the cam member 43B is located. Thus, there is no problem, and the subsequent traveling of the rod 22 can be allowed.

The door stop 10B according to the second embodiment is economical because the number of parts is less than that of the door stop 10A according to the first embodiment. Even if the user vigorously performs the operation on the door 1 in the direction to open (in the direction of the arrow A in FIG. 1), the same effect can be certainly demonstrated such that the entering speed of the rod 22 can be reliably reduced (regulated), and the rod 22 can be locked to the locking portion.

Third Embodiment

The door stop 10A according to the above-described first embodiment includes, as a configuration for preventing the rod 22 that is locked to the locking portion 58 from returning to the entrance path 56, a configuration such that the rod 22 is prevented from returning to the entrance path 56 by the step that is formed by lowering the height of the locking portion 58 relative to the height of the entrance path 56 at the end portion in the direction of the arrow Y1. In contrast, the door stop according to the third embodiment can be implemented, so that the entrance path 56, the locking portion 58, and the return path 59 that are formed in the cam member 43B have the same height, though depiction is omitted. The speed regulation path 57 may preferably have the same configuration as that of the first embodiment. In this case, the cam springs 45 and 46 may be required.

Modified Example

The locking member (the cam members 43A and 43B) according to the embodiment is explained above by exemplifying the configurations in which it is implemented in the door stops 10A and 10B. However, it is not limited to these, and it can be similarly implemented in a gate, a lid, or the like that includes an opening and closing system. Namely, it can be similarly applied to a gate, a lid, or the like of furniture, a showcase, and so forth.

The preferred embodiments of the present invention are described in detail above. However, the present invention is not limited to the above-described specific embodiments, and various modifications and alterations may be made within the scope of the gist of the present invention that is described in the scope of the claims.

This application is based on and claims the benefit of priority of Japanese Patent Application No. 2014-075471 filed on Apr. 1, 2014, the entire contents of which are hereby incorporated herein by reference.

REFERENCE SIGNS LIST

1: door
2: floor
10A, 10B: door stop
20A: rod system
21: case
22: rod
24: coil spring
40A, 40B: rod locking system
41: cam cover
42: base
43A, 43B: cam member
44: cam holder
45, 46: cam spring
48A, 48B: rod path
50: rod insertion groove
54, 55: rod entrance
56: entrance path
57: speed regulation path (speed regulation path portion)
57*c*, 57*d*: rod receiving portion
58: locking portion
58*a*: speed regulation path side end portion
58*b*: return path side end portion
59: return path
80: rod insertion guide portion

The invention claimed is:

1. A locking member for locking a rod in a path for the rod to pass through, the locking member comprising:

a speed regulation path portion for regulating entering speed of the rod by causing the rod that enters inside the path to fluctuate; and a locking portion for restricting movement of the rod by locking the rod whose entering speed is regulated, wherein the speed regulation path portion extends in a vertical direction that is perpendicular to a width direction of the locking member, and wherein the speed regulation path portion includes rod receiving portions that are disposed at a start edge and an end edge of the speed regulation path portion, respectively, wherein the rod receiving portions are shaped to receive an outer peripheral surface of the rod, wherein a height difference is formed, by a recess surface portion of the speed regulation path portion and a flat ascending portion of the speed regulation path portion, at a bottom portion of the speed regulation path portion to be contacted by the rod, the flat ascending portion being connected to the recess surface portion, and wherein each one of the rod receiving portions receives the rod that enters the speed regulation path portion and returns the rod to the other one of the rod receiving portions, and the height difference of the bottom portion causes the rod to fluctuate in a forward and backward direction by contacting the rod so as to regulate the entering speed of the rod.

2. The locking member according to claim 1, wherein the locking member includes the path for the rod to pass through, and wherein the path is formed to have a substantially heart shape.

3. A door stop comprising:

a rod system that is to be attached to a door and that includes a rod that extends toward a floor; and a rod locking system that is disposed on the floor and that is for locking the door in an opened state by locking the rod, wherein the rod locking system includes a locking member that is movable along the floor, the locking member including a speed regulation path portion for regulating entering speed of the rod by causing the rod to fluctuate, wherein the rod enters due to a motion of the door in a direction to open, and a locking portion for restricting movement of the rod by locking the rod whose entering speed is regulated, wherein the speed regulation path portion extends in a vertical direction that is perpendicular to a width direction of the locking member, and wherein the speed regulation path portion includes rod receiving portions that are disposed at a start edge and an end edge of the speed regulation path portion, respectively, wherein the rod receiving portions are shaped to receive an outer peripheral surface of the rod, wherein a height difference is formed, by a recess surface portion of the speed regulation path portion and a flat ascending portion of the speed regulation path portion, at a bottom portion of the speed regulation path portion to be contacted by the rod, the flat ascending portion being connected to the recess surface portion, and wherein each one of the rod receiving portions receives the rod that enters the speed regulation path portion and returns the rod to the other one of the rod receiving portions, and the height difference of the bottom portion causes the rod to fluctuate in a forward and backward direction by contacting the rod so as to regulate the entering speed of the rod.

4. The door stop according to claim 3, wherein the locking member includes a path for the rod to pass through, wherein the path has a substantially heart shape, and wherein the path includes an entrance path portion for causing the rod to enter in accordance with the motion of the door in the direction to open for a first time, the speed regulation path portion for regulating the entering speed by causing the rod to fluctuate in the forward and backward direction, the locking portion for restricting the movement by locking the rod, and a return path portion for returning the rod after the motion of the door in the direction to open for a second time.

5. The door stop according to claim 3, wherein, at the end edge of the speed regulation path portion, a tilted portion is provided that is tilted upward with respect to an entering direction of the rod, and wherein a tilted surface of the tilted portion is tilted in a direction to guide the rod whose speed is regulated toward the neighboring locking portion.

6. A rod locking system that is included in a door stop for locking a door in an opened state and that is for releasably locking movement of a rod that is provided in the door and that extends toward a floor, the rod locking system comprising:

a locking member that is movable along the floor, the locking member including a speed regulation path portion for regulating entering speed of the rod by causing the rod to fluctuate, wherein the rod enters due to a motion the door in a direction to open, and a locking portion for restricting movement of the rod by locking the rod whose entering speed is regulated, wherein the speed regulation path portion extends in a vertical direction that is perpendicular to a width direction of the locking member, and wherein the speed regulation path portion includes rod receiving portions that are disposed at a start edge and an end edge of the speed regulation path portion, respectively, wherein the rod receiving portions are shaped to receive an outer peripheral surface of the rod, wherein a height difference is formed, by a recess surface portion of the speed regulation path portion and a flat ascending portion of the speed regulation path portion, at a bottom portion of the speed regulation path portion to be contacted by the rod, the flat ascending portion being connected to the recess surface portion, and wherein each one of the rod receiving portions receives the rod that enters the speed regulation path portion and returns the rod to the other one of the rod receiving portions, and the height difference of the bottom portion causes the rod to fluctuate in a forward and backward direction by contacting the rod so as to regulate the entering speed of the rod.

* * * * *